US007277060B2

(12) United States Patent
Fukuchi

(10) Patent No.: US 7,277,060 B2
(45) Date of Patent: Oct. 2, 2007

(54) ANTENNA

(75) Inventor: Keisuke Fukuchi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/484,609

(22) Filed: Jul. 12, 2006

(65) Prior Publication Data

US 2007/0013596 A1 Jan. 18, 2007

(30) Foreign Application Priority Data

Jul. 12, 2005 (JP) ..... 2005-203265
Feb. 13, 2006 (JP) ..... 2006-035327

(51) Int. Cl.
*H01Q 13/10* (2006.01)

(52) U.S. Cl. ..... 343/767; 343/768

(58) Field of Classification Search ..... 343/767, 343/768, 770
See application file for complete search history.

(56) References Cited

U.S. PATENT DOCUMENTS 6,839,036 B1 * 1/2005 Apostolos et al. ..... 343/770
6,882,322 B1 * 4/2005 Apostolos et al. ..... 343/767
6,900,770 B2 * 5/2005 Apostolos ..... 343/725
7,057,568 B2 * 6/2006 Louzir et al. ..... 343/767

FOREIGN PATENT DOCUMENTS

| | | |
|---|---|---|
| JP | 2004-343424 | 12/2004 |
| JP | 2005-094499 | 4/2005 |
| JP | 2005-150804 | 6/2005 |

* cited by examiner

*Primary Examiner*—Hoanganh Le
(74) *Attorney, Agent, or Firm*—Antonelli, Terry, Stout & Kraus, LLP.

(57) ABSTRACT

In an antenna to be used for UWB communication, a taper slot is formed in a rectangular conductive plate, a vertical slit for separating the conductive pate is formed at the top of the taper slot, a feeding point part and a grounding point part are formed at the conductive plate and on both sides of the vertical slit, and the lower slits are formed on the oblique sides of the taper slot near the feeding point part and the grounding point part.

18 Claims, 5 Drawing Sheets

ANTENNA

BACKGROUND OF THE INVENTION

The present invention relates to a small-size and wideband antenna, especially to an antenna applicable to an UWB (Ultra Wide Band) communication devise based on the next-generation and very high-speed communication method.

UWB (Ultra Wide Band) is based on the wireless communication technology enabling very high-speed communication faster than optical fibers, and expected as a prospective communication means alternative to Blue Tooth™ using 2.4 GHz band and the existing wireless LAN, IEEE802.1a using 5 GHz band.

UWB is a multi-band communication method using a wide frequency band from 3.1 GHz to 10.6 GHz for establishing a very high-speed communication for 100 Mbps to 1 Gbps. The antennas used for UWB are required to have a wideband characteristic different from the previous ones.

According to UWB Standard activities, the bandwidth between 3 GHz and 5 GHz is almost determined to be used for the first-generation UWB communication.

As for the conventional antenna for UWB communication, the Japanese Patent Laid-Open No. 150804 (2005) discloses such an antenna structure as the conductive element shaped in a home base is provided between the dielectric materials and the top part of the conductive element shaped in a home base is connected to the ground via a power supply. Japanese Patent Laid-Open No. 343424 (2004) discloses the modification of Sierpinski antenna, and Japanese Patent Laid-Open No. 94499 (2005) discloses the modification of a patch antenna.

SUMMARY OF THE INVENTION

It is desirable that the antenna used for UWB communication has a bandwidth applicable to UWB operation and is configured to be small and thin profile enough to be installed as UWB antenna into the devices such as notebook computer.

An object of the present invention is to provide such an antenna that has a bandwidth applicable to UWB operation and may be configured to be small and thin profile.

In order to achieve the above object, an antenna according to the present invention is configured so that a taper slot is formed in a rectangular conductive plate, a first slit for separating the conductive plate is formed at a top of the taper slot, a feeding point part and a grounding point part are formed separately on both sides of the first slit, and a second slit is formed on each oblique side of the taper slot.

Preferably, the second slits are formed near the feeding point part and the grounding point part.

In order to achieve the above object, an antenna according to the present invention is configured so that a taper slot is formed in a rectangular conductive plate, the first slit for separating the conductive plate is formed at a top of the taper slot, a feeding point part and a grounding point part are formed separately on both sides of the first slit, a second slit is formed on each oblique side of the taper slot, and a third slit is formed on each oblique side of the taper slot between the second slits and the bottom of the taper slot.

Preferably, the third slits are formed near the middle of the oblique sides of the taper slot.

The present invention can realize such an antenna that has a bandwidth applicable to UWB operation and may be configured to be small and thin profile.

DETAILED DESCRIPTION OF THE PREFERRED EMBODIMENTS

Embodiments of the present invention will be described in detail by referring to the attached drawings.

Figure 1:
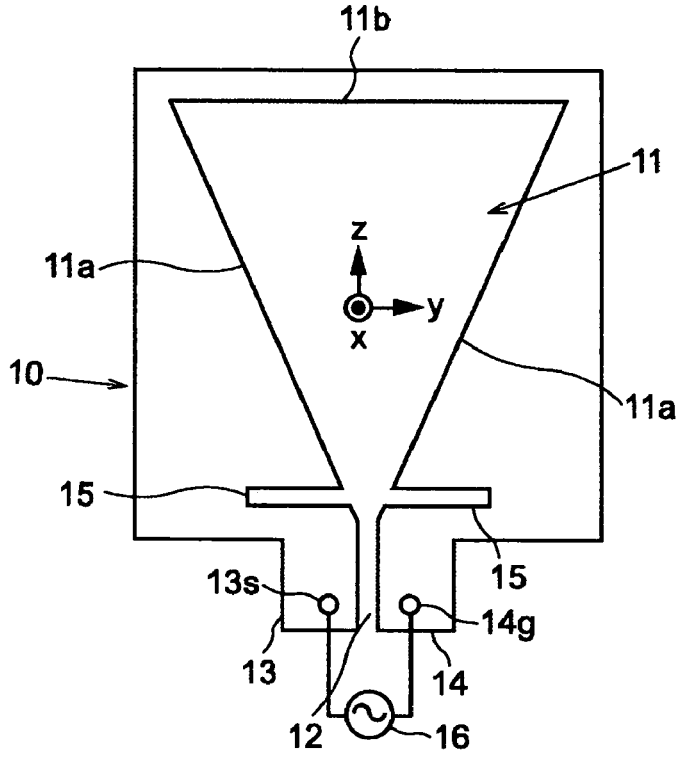
FIG. 1 is a schematic view of one embodiment according to the present invention.

FIG. 1 shows a schematic view of one embodiment of the antenna according to the present invention.

The antenna of this embodiment comprises a rectangular conductive plate 10, a triangular taper slot 11, a vertical slit (first slit) 12 formed so as to extend from the top of the taper slot 11 and separate the conductive plate 10, a feeding point part 13 and a grounding point part 14 formed separately on both sides of the vertical slot 12, and lower slits (second slits) 15 formed on oblique sides 11*a* of the taper slot 11 near the feeding point part 13 and the ground point part 14.

The conductive plate 10 is formed as a rectangle with 23 mm in the horizontal direction and 25 mm in the longitudinal direction by applying punching work to the metallic plate such as lead frame. The angle defined by the oblique sides 11*a* of the taper slot 11 is approximately 40 to 50 degrees. The taper slot 11 is formed so that the sum of the length of the oblique sides 11*a* of the taper slot 11 and the length of the bottom of the taper slot 11 may be approximately 70 mm (25 mm oblique sides and 20 mm bottom).

In addition, the vertical slit 12 is formed by applying punching work to the conductive plate 10 so that the vertical slit 12 may reach the top of the taper slot 11 from the bottom of the rectangular conductive plate 1 as shown in FIG. 1. The feeding point part 13 and the grounding point part 14 are provided on individual sides of the vertical slit 12.

The lower slits 15 shaped in a rectangle and extending in the horizontal direction in FIG. 1 are formed at the oblique sides 11*a* of the taper slot 11 near the feeding point part 13 and the grounding point part 14.

Figure 3A:
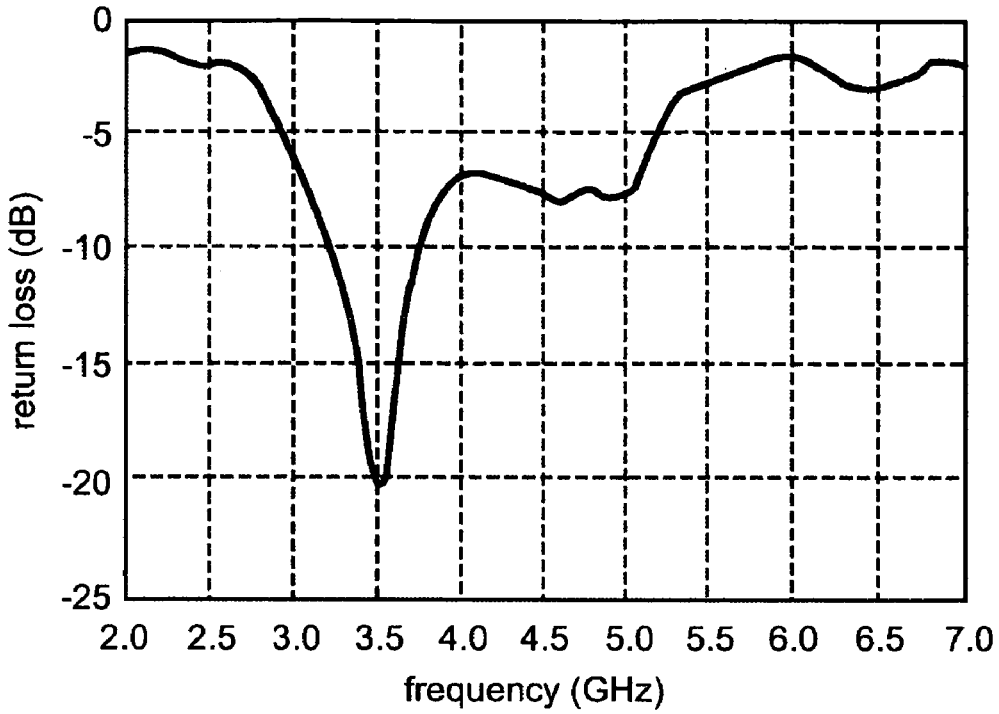
FIG. 3A and FIG. 3B are characteristic curves of the small wideband antenna shown in FIG. 1.

FIG. 3A shows a characteristic curve of the return loss to the frequency in the configuration that the radio waves are irradiated by supplying RF electric power 16 between the feeding point part 13 and the grounding point part 14. It is proved that the return loss has its minimum value at the frequency of 3.5 GHz, and that the return loss is −6 dB at the frequency range between 3 GHz and 5 GHz which provides the band-width to center frequency ratio of 50% or higher.

Figure 3B:
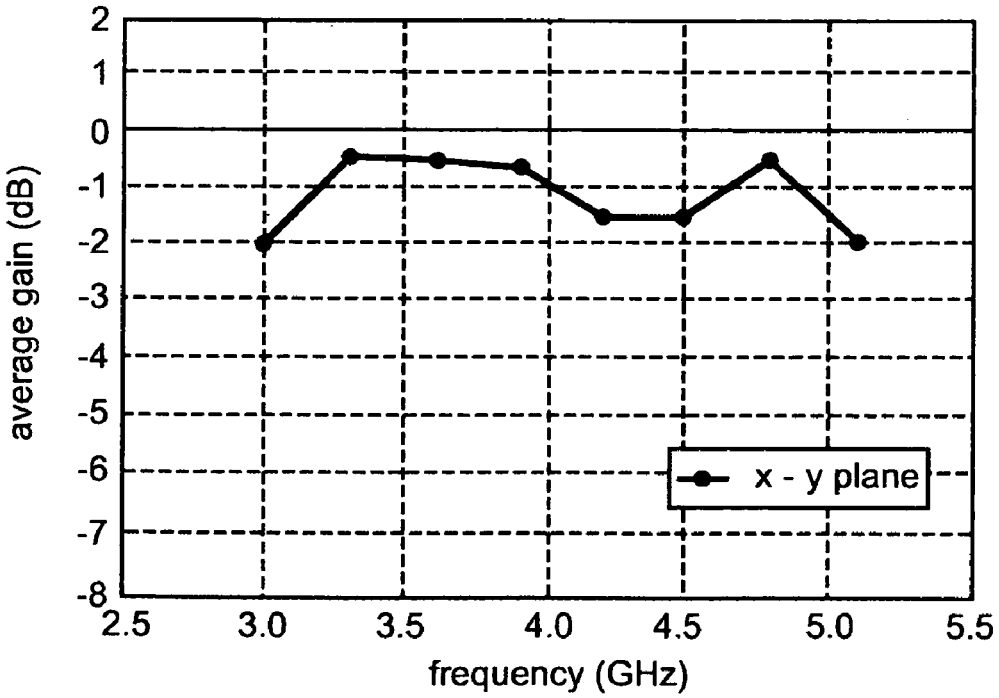

FIG. 3B shows a characteristic curve of the average gain to the frequency measured on the x-y plane of the antenna in FIG. 1, in which the x-axis is defined as the perpendicular line to the drawing sheet, the y-axis is defined as the horizontal direction on the drawing sheet and the z-axis is defined as the vertical direction on the drawing sheet. The average gain in the x-y plane is −2 dB to −1 dB at the frequency range from 3 GHz and 5 GHz.

The antenna according to the present invention is configured as a loop antenna. The resonant frequency of the conventional circular loop antenna depends on the length of the loop. In contrast, the antenna according to the present invention can provide wider resonant frequency because a taper slot forms the loop configuration.

Figure 4:
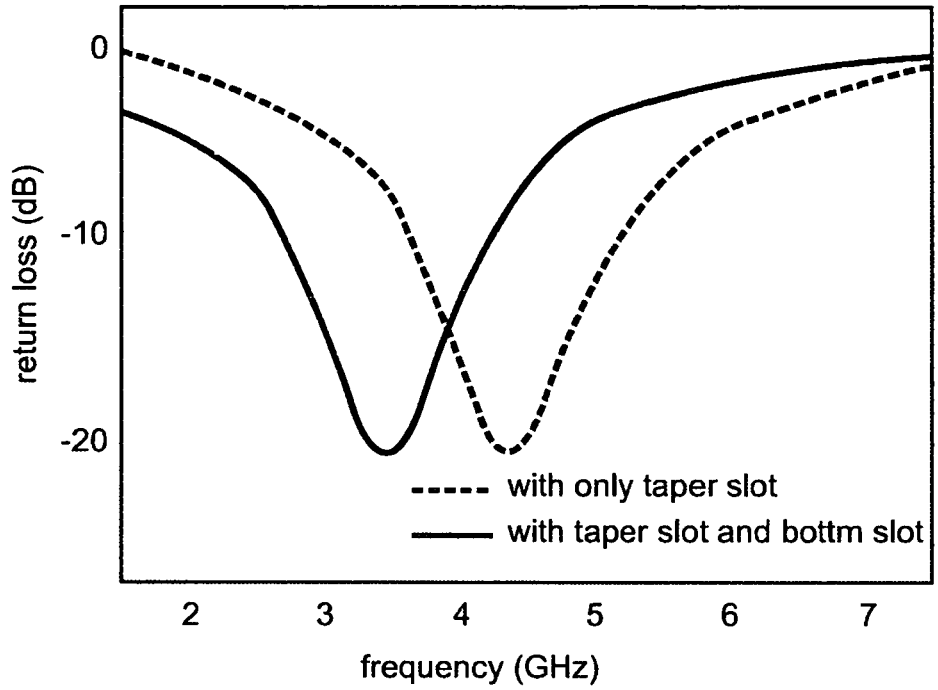
FIG. 4 is a characteristic curve of the antennas with a taper slot alone and with a taper slot with lower slits formed, respectively, according to the present invention.

FIG. 4 shows antenna characteristics (the return loss to the frequency) in both cases for the triangular taper slot 11 without lower slits and with lower slits 15 formed.

In case of the antenna configured only with the taper slot as shown by broken lines (the length of the edge of the taper slot being 70 mm), its resonant frequency is 4.5 GHz (the wavelength of 66.7 mm). In case of the antenna configured with the lower slits added as shown in solid lines, its resonant frequency is 3.5 GHz. Thus, the resonant frequency can be reduced by providing lower slits in the antenna without changing the surface area of the antenna itself.

In general, the wavelength corresponding to the resonant frequency of the loop antenna is identical to the entire perimeter length of the loop antenna. In attempting to shift the resonant frequency downward, it is required to make the enter perimeter length of the loop antenna (that is, the aperture angle and the length of the taper slot) long enough to correspond to the desired resonant frequency, which necessarily results in the larger surface area of the antenna. In contrast, by means of adding the lower slits 15 in the present invention, the substantial length of the edge of the taper slot 11 can be reduced and the resonant frequency can be shifted downward with a smaller surface area of the antenna. This can be established because the length from the feeding point 13*s* of the feeding point part 13 to the grounding point 14*g* of the grounding point part 14 changes, and the length of the resonant loop configuration can be extended by changing the length and the width of the lower slits 15, which may result in the downward shift of the resonant frequency.

Though lower slits 15 may be formed at the arbitrary position on the oblique sides 11*a* of the taper slot 11, it is especially preferable that the lower slits 15 are formed near the grounding point 14*g* so that the feeding path from the feeding point 13*s* to the grounding point 14*g* may be increased effectively.

In this embodiment, the frequency shift downward in the resonant frequency corresponding to the unit length, 1 mm, of the lower slits 15 to be formed near the feeding point of the taper slot 11 is, for example, 200 MHz for the 1 mm change in the length of the single slit having the width of 1 mm. The resultant resonant frequency shift of 1 GHz can be obtained by making the length of the slit 5 mm.

In case of making the width of the slit wider, the shifted frequency is determined by the product of the width of the slit and the change in the length of the slit. For example, in case that the width of the slit is 1.5 mm, the shifted frequency is approximately 300 MHz by change the length of the single slit by 1 mm.

The antenna in this embodiment may be so configured as to have a higher resonant frequency by forming the taper slot 11 and have a lower resonant frequency by forming the lower slits 1. Thus, the antenna in this embodiment can have the required bandwidth applicable to UWB communication (for example, 3 to 5 GHz band width to be used for the first generation UWB communication), and also can be realized as a small and thin profile component.

Figure 2:
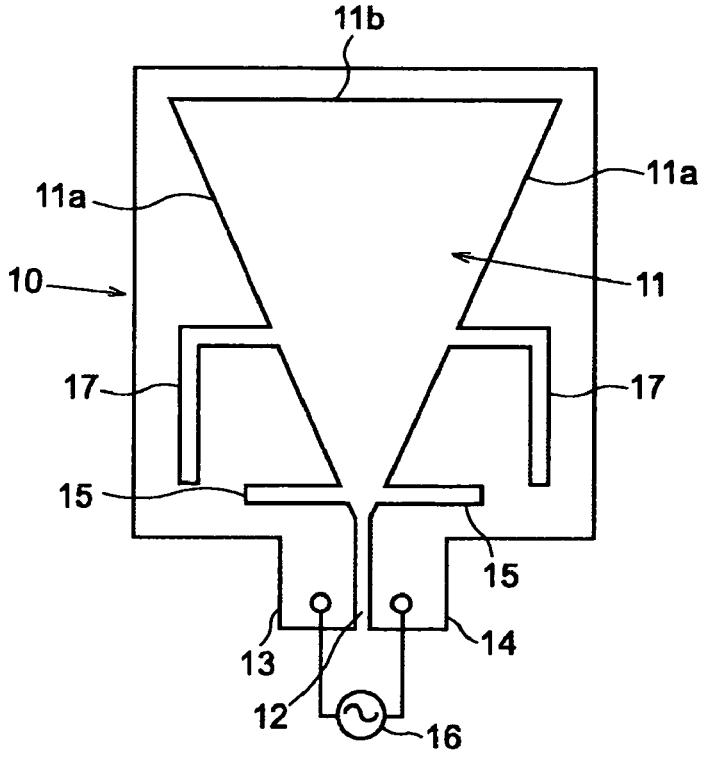
FIG. 2 is a schematic view of another embodiment according to the present invention.

FIG. 2 shows another embodiment of the antenna according to the present invention.

As shown in FIG. 2, the antenna of this embodiment is formed by adding L-shaped side slits 17 (third slits) to the antenna shown in FIG. 1, which the L-shaped side slits are formed on the oblique sides 11*a* and 11*a* between the lower slits 15 and the bottom 11*b* of the taper slot 11.

Figure 5:
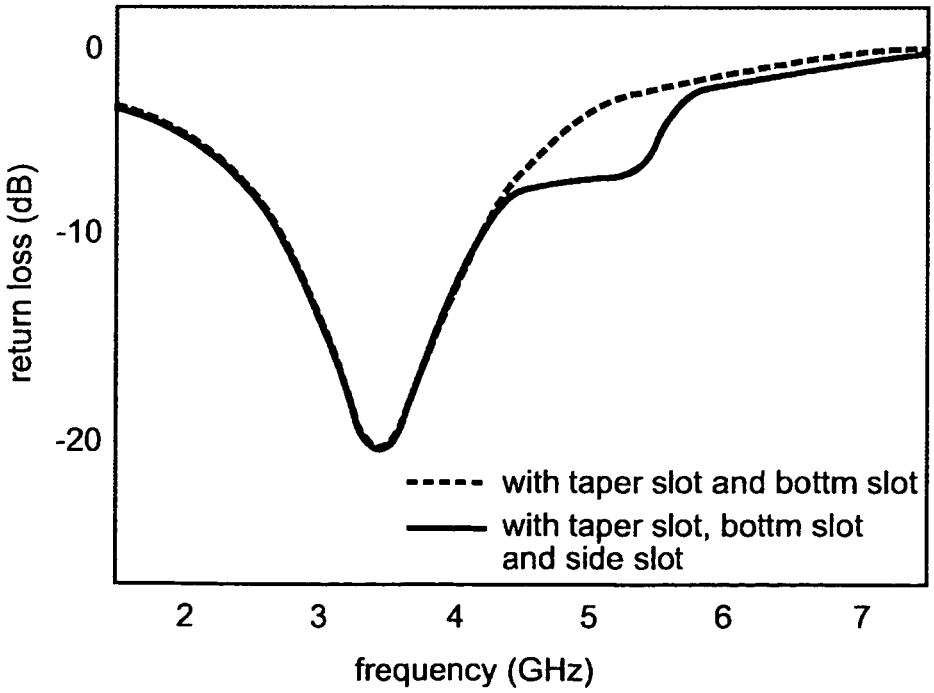
FIG. 5 is a characteristic curve of the antenna with a side slits formed according to the present invention.

FIG. 5 shows characteristic curves (the return loss to the frequency) of the antenna shown FIG. 1 and the antenna having the side slits in this embodiment, respectively. The broken line shows the characteristic curve of the antenna shown in FIG. 1 in which the lower slits 15 are formed at the taper slot 11, and the solid line shows a characteristic curve of the antenna shown in FIG. 2 in which the lower slits 15 and the side slits 17 are formed at the taper slot 11.

As shown in FIG. 5, it is proved that the return loss at the frequencies from 4.4 GHz to 5.5 GHz may be reduced by forming the side slits 17.

Though the side slits 17 may be formed at the arbitrary position on the oblique sides 11*a* from the lower slits 15 to the bottom 11*b*, its operation can be made most efficient by forming the side slits at the middle of the oblique sides.

By means of forming the side slits 17, the second resonant frequency region can be realized above the resonant frequency region established only by forming the taper slot 11. This means that, by forming the side slits 17 at the proper position, the wideband antenna can be realized with an identical surface area of the antenna having the taper slot 11 alone.

In this embodiment, the frequency shift upward of the second resonant frequency region corresponding to the unit length of the side slits 17 is approximately 100 MHz for the 1 mm change in the length of the single slit having the width of 1 mm.

In the embodiment shown in FIG. 2, in which the slit has a width of 1 mm, and the overall length of the inversed-L shaped slit is approximately 10 mm, it will be appreciated that second resonant frequency region having 1.2 GHz bandwidth can be established at the center frequency of 5 GHz.

As described above, the antenna in this embodiment, in which the side slits are formed, can provide wider bandwidth in the higher frequency region and have the required bandwidth applicable to UWB communication and also can be realized as a small and thin profile component.

Figure 6:
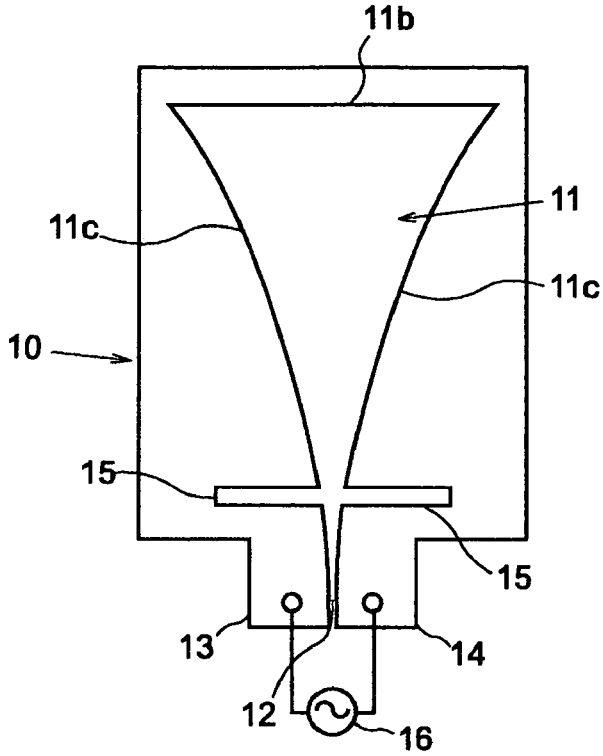
FIG. 6 is a schematic view of a further embodiment according to the present invention.
Figure 7:
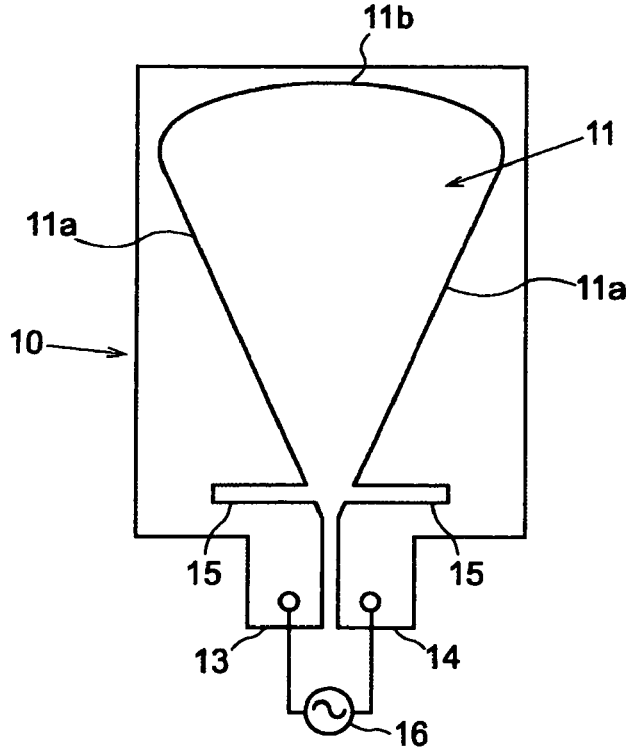
FIG. 7 is a schematic view of a further embodiment according to the present invention.

FIG. 6 and FIG. 7 show further embodiments of the present invention.

The antenna of the embodiment shown in FIG. 6 is realized by defining the shape of the taper slot 11 to be curved so as to make the oblique sides 11*c* convex inward, that is, the taper slot 11 is formed entirely to be flare-shaped. The antenna of the embodiment shown in FIG. 7 is realized by defining the bottom 11*d* to be curved so as to make the bottom convex outward, that is, the taper slot 11 is formed to be fan-shaped.

In the embodiments shown in FIG. 6 and FIG. 7, the electric and magnetic field distribution to be formed at the taper slot 11 can be controlled by defining the shape of the oblique sides and the bottom of the taper slot 11 to be curved, which leads to shifting intentionally the resonant frequency. It is allowed to define the shape of the taper slot to be rhombus-shaped.

Figure 8:
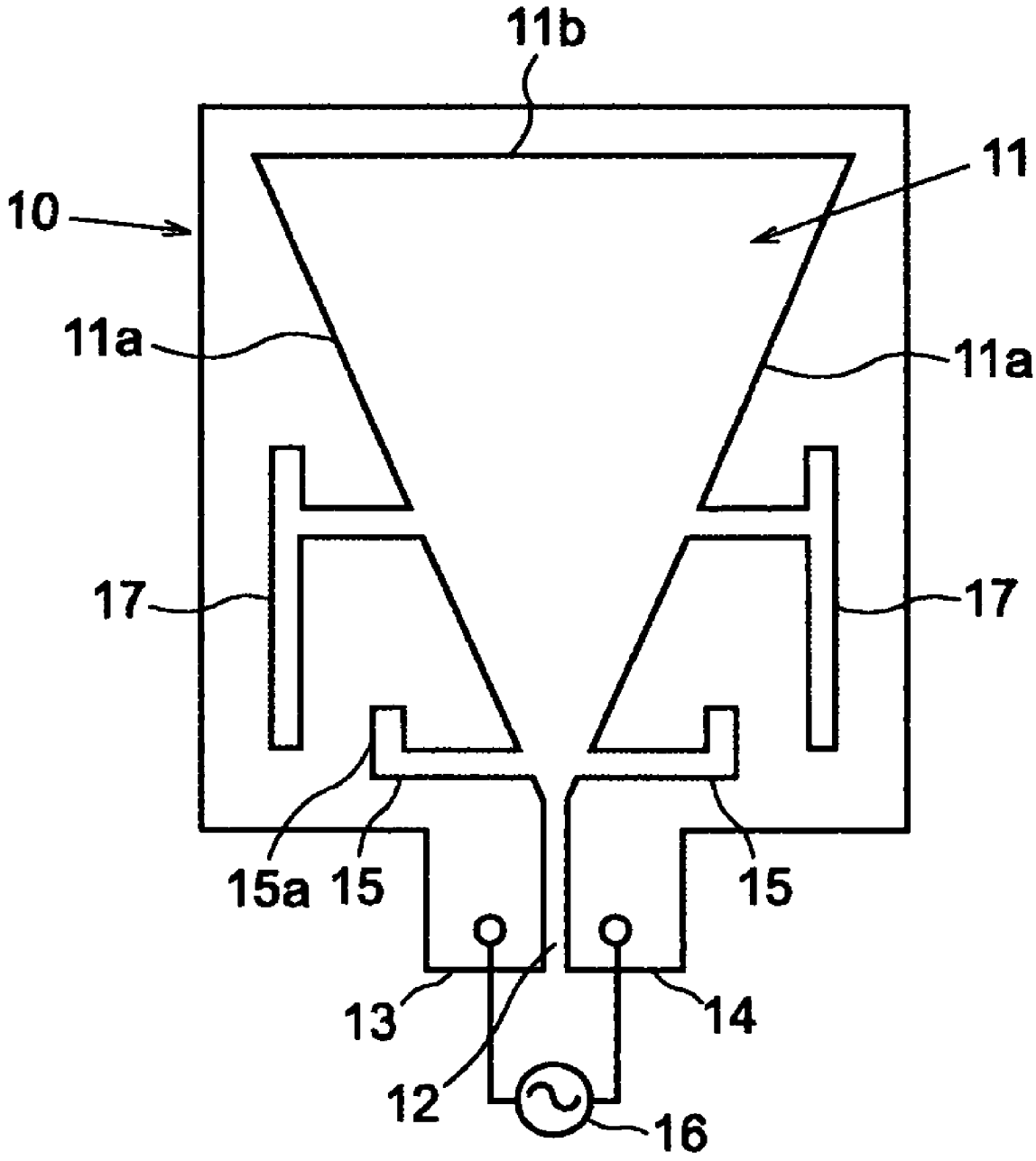
FIG. 8 is a schematic view of a further embodiment according to the present invention.

FIG. 8 shows a further embodiment of the present invention.

The antenna of the embodiment shown in FIG. 8 is realized by adding the slit 15*a*, being oriented upward in FIG. 8, to the top of the lower slits 15 of the antenna shown in FIG. 2, which leads resultantly to the L-shaped lower slits 15. In addition, the side slits 17 are also modified to be T-shaped.

In the antenna of this embodiment, the resonant frequency can be controlled intentionally by modifying the shape of the lower slits 15 and the side slits 17.

As described above, the antenna according to the present invention is small and thin profile, and can provide a wider bandwidth applicable to UWB communication.

The antennas realized by downsizing the conventional monopole antenna or the conventional slot antenna may often require the additional grounding point outside, which arise such a problem that the installation of the antenna component may not be facilitated efficiently in the application to the actual devices such as notebook-size personal computer. In order to solve this kind of problem, the antenna according to the present invention operates well functionally as a loop antenna, and any additional grounding point is not required due to the configuration which integrates the feeding point part and the grounding point part, which leads to making it easier to install the antenna component.

Although the present invention has been illustrated and described with respect to exemplary embodiments thereof, it should be understood by those skilled in the art that the foregoing and various other changes, omission and additions may be made therein and thereto, without departing from the spirit and scope of the present invention. Therefore, the present invention should not be understood as limited to the specific embodiments set out above but to include all possible embodiments which can be embodied within a scope encompassed and equivalent thereof with respect to the feature set out in the appended claims.

What is claimed is:

1. An antenna, comprising;

a rectangular conductive plate, a taper slot formed in said rectangular conductive plate, where said taper slot is bounded on three sides by portions of said rectangular conductive plate, a first slit formed at a top of said taper slot, which separates said rectangular conductive plate, a feeding point part formed on one side of said first slit, a grounding point part formed on the other side of said first slit, and a second slit formed on each oblique side of said taper slot.

2. The antenna according to claim 1, wherein said second slit is formed near said feeding point part and said grounding point part.

3. The antenna according to claim 1, wherein said second slit is shaped as a rectangle.

4. The antenna according to claim 1, wherein each opposing end of said second slit is shaped in an L-shape.

5. The antenna according to claim 1, wherein said taper slot is formed in a triangle shape, a flare shape, a fan shape or a rhombic shape.

6. The antenna according to claim 1, wherein said feeding point part and said grounding point part are provided toward an end of said first slit which is opposite an end of said first slit which interfaces with said taper slot.

7. An antenna, comprising;

a rectangular conductive plate, a taper slot formed in said rectangular conductive plate, a first slit formed at a top of said taper slot, which separates said rectangular conductive plate, a feeding point part formed on one side of said first slit, a grounding point part formed on the other side of said first slit, a second slit formed on each oblique side of said taper slot, and a third slit formed on each oblique side of said taper slot between said second slits and a bottom of said taper slot.

8. The antenna according to claim 7, wherein said third slit is formed at almost center of the oblique sides of said taper slot.

9. The antenna according to claim 7, wherein each opposing end of said third slit is shaped in an L-shape.

10. The antenna according to claim 7, wherein each opposing end of said third slit is shaped in a T-shape.

11. The antenna according to claim 7, wherein said taper slot is formed in a triangle shape, a flare shape, a fan shape or a rhombic shape.

12. The antenna according to claim 7, wherein said feeding point part and said grounding point part are provided toward an end of said first slit which is opposite an end of said first slit which interfaces with said taper slot.

13. An antenna, comprising:

a rectangular conductive plate, a taper slot formed in said rectangular conductive plate, which has two oblique sides opposed to each other and a bottom, to form a loop antenna portion, a first slit formed at a top of said taper slot, which separates said rectangular conductive plate, a feeding point part formed on one side of said first slit, a grounding point part formed on the other side of said first slit, and a second slit formed on each oblique side of said taper slot.

14. The antenna according to claim 13, wherein said second slit is formed near said feeding point part and said grounding point part.

15. The antenna according to claim 13, wherein said second slit is shaped as a rectangle.

16. The antenna according to claim 13, wherein each opposing end of said second slit is shaped in an L-shape.

17. The antenna according to claim 13, wherein said taper slot is formed in a triangle shape, a flare shape, a fan shape or a rhombic shape.

18. The antenna according to claim 13, wherein said feeding point part and said grounding point part are provided toward an end of said first slit which is opposite an end of said first slit which interfaces with said taper slot.

* * * * *